US007193399B2

(12) United States Patent
Aikawa

(10) Patent No.: US 7,193,399 B2
(45) Date of Patent: Mar. 20, 2007

(54) VOLTAGE REGULATOR

(75) Inventor: Akiyoshi Aikawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/406,330

(22) Filed: Apr. 19, 2006

(65) Prior Publication Data

US 2007/0018625 A1 Jan. 25, 2007

(30) Foreign Application Priority Data

Jul. 21, 2005 (JP) ..... 2005-210815

(51) Int. Cl.
*G05F 1/40* (2006.01)

(52) U.S. Cl. ..... 323/282

(58) Field of Classification Search ..... 323/268, 323/273, 282, 284, 285, 351
See application file for complete search history.

(56) References Cited

U.S. PATENT DOCUMENTS 6,806,694 B2 * 10/2004 Rupp et al. ..... 323/282
7,002,329 B2 * 2/2006 Agari et al. ..... 323/284
7,030,596 B1 * 4/2006 Salerno et al. ..... 323/282
7,071,660 B2 * 7/2006 Xu et al. ..... 323/266

FOREIGN PATENT DOCUMENTS

JP 2001-211640 8/2001

* cited by examiner

*Primary Examiner*—Adolf Berhane
(74) *Attorney, Agent, or Firm*—Nixon Peabody LLP; Donald R. Studebaker

(57) ABSTRACT

Consumption current is reduced for a voltage regulator in sleep mode. In normal operation mode, a sub-regulator circuit is ceased from operating according to a power-down signal, which allows an operation amplifier to compare between a reference voltage outputted from a reference voltage circuit and a monitor voltage generated by a voltage-dividing circuit. Based on a detection voltage as a comparison result, a PMOS is controlled to regulate an internal power voltage such that the monitor voltage becomes equal to the reference voltage. In sleep mode, the reference voltage circuit and operational amplifier is ceased from operating, to start up the sub-regulator circuit. A slight current, restricted by a resistance, flows through a PMOS of the sub-regulator circuit. The same magnitude of current is supplied from the PMOS constituting a current mirror to a PMOS, etc. of a threshold-voltage output circuit. The threshold voltage, at a node between the PMOS constituting the current mirror and the PMOS of the threshold-voltage output circuit, is power-amplified by a voltage follower and outputted through an output terminal.

19 Claims, 4 Drawing Sheets

VOLTAGE REGULATOR

BACKGROUND OF THE INVENTION

1. Field of the Invention

The present invention relates to a voltage regulator that is to output a constant voltage regardless of the variations in power voltage supplied or load current outputted, and more particularly to the reduction of current consumption in the power save mode thereof.

2. Description of the Related Art

FIG. 1 is a configuration diagram of an existing voltage regulator.

The voltage regulator is configured with a reference voltage circuit 1 that generates a reference voltage REF based on a band gap, etc., an operational amplifier (OP) 2 that compares the reference voltage REF with a monitor voltage VM and outputs a detection voltage VD according to the difference thereof, a P-channel MOS transistor (hereinafter, referred to as "PMOS") 3 connected between a power voltage VDD externally supplied and an output node N outputting a constant internal power voltage REG, in a manner controlled in conduction by a detection voltage VD, and a voltage-dividing circuit of resistances 4, 5 connected between the output node N and the ground voltage GND and for outputting a monitor voltage VM in a magnitude the internal power voltage is voltage-divided.

In the voltage regulator, when the resistances 4, 5 have respective values R4, R5, the monitor voltage VM is given as REG×R5/(R4+R5). The monitor voltage VM is provided to an inverting input terminal "+" of the operational amplifier 2 while the reference voltage REF is provided to a non-inverting input terminal "−" of the operational amplifier 2.

In this case, when the internal power voltage REG changes due to the variation in the power voltage VDD or load current flowing through the output node N thereby the monitor voltage VM becomes higher than the reference voltage REF, which causes an increase in the detection voltage VD outputted from the operational amplifier 2. This increases the on-resistance of the PMOS 3 and decreases the internal power voltage REG on the node N. Conversely, when the monitor voltage VM becomes lower than the reference voltage REF, there is a decrease in the detection voltage VD outputted from the operational amplifier 2, to decrease the on-resistance of the PMOS 3. This increases the internal power voltage REG on the node N. By such a feedback operation, the monitor voltage VM is controlled equal to the reference voltage REF. Accordingly, the internal power voltage REG is maintained constant at voltage REF×(R4+R5)/R5 on the output node N regardless of the variations in the power voltage VDD or the load current flowing through the output node N.

Furthermore, the related art is disclosed in Japanese Patent Kokai No. 2001-211640, for example.

SUMMARY OF THE INVENTION

However, in the voltage regulator circuit, current consumption occurs on the reference voltage circuit 1 and operational amplifier 2 also when no load current flows. For this reason, if attempted to suppress the entire consumption current by placing the LSI (large scale integration) in sleep mode, the consumption current of the voltage regulator still exists. Thus, there is a problem that consumption current is not reduced thoroughly.

It is an object of the present invention to reduce the current consumption for a voltage regulator in sleep mode.

A voltage regulator according to the invention comprises: a reference voltage circuit that generates a reference voltage in normal operation mode and ceases operation in sleep mode; an amplifier circuit that outputs in a normal operation mode a detection signal obtained by comparing a monitor voltage with the reference voltage and amplifying a difference thereof and ceases operation in a sleep mode; a P-channel MOS transistor that is connected between a power terminal a power voltage is to be supplied and an output terminal an internal power voltage is to be outputted, and to be controlled in conduction according to a detection voltage; a resistance-based voltage-dividing circuit that is connected between a ground terminal a ground voltage is applied and the output terminal, and supplies to the amplifier circuit the monitor voltage obtained by dividing a voltage on the output terminal; and a sub-regulator circuit that generates a low power voltage different in magnitude from the internal power voltage and outputs same to the output terminal in sleep mode, and ceases operation in the normal operation mode.

The voltage regulator according to the invention has the reference voltage circuit and amplifier circuit that ceases operation in sleep mode, and a sub-regulator circuit that, in sleep mode, generates the lower power voltage different from the internal power voltage and supplies same to the output terminal. This provides an effect that the consumption current can be reduced in sleep mode.

The sub-regulator circuit may be configured having a reference-current circuit that allows a reference current to flow via a first transistor and resistance connected between the power voltage and the ground voltage, a second transistor that allows a current according to the reference current to flow by constituting a current mirror circuit with respect to the first transistor, one or a plurality of third transistors normally on that output a threshold voltage based on a current supplied from the second transistor, and a voltage-follower circuit that outputs the threshold voltage.

Meanwhile, between the output of the sub-regulator circuit and the output terminal, a switch circuit is provided which, in sleep mode, turns on to output to the output terminal a low power voltage generated in the sub-regulator circuit and, in the normal operation state, turns off.

Furthermore, between the resistance-based voltage-dividing circuit and the ground terminal or between the resistance-based voltage-dividing circuit and the output terminal, a switch transistor is provided to turn off in sleep mode.

DETAILED DESCRIPTION OF THE INVENTION

Figure 2:
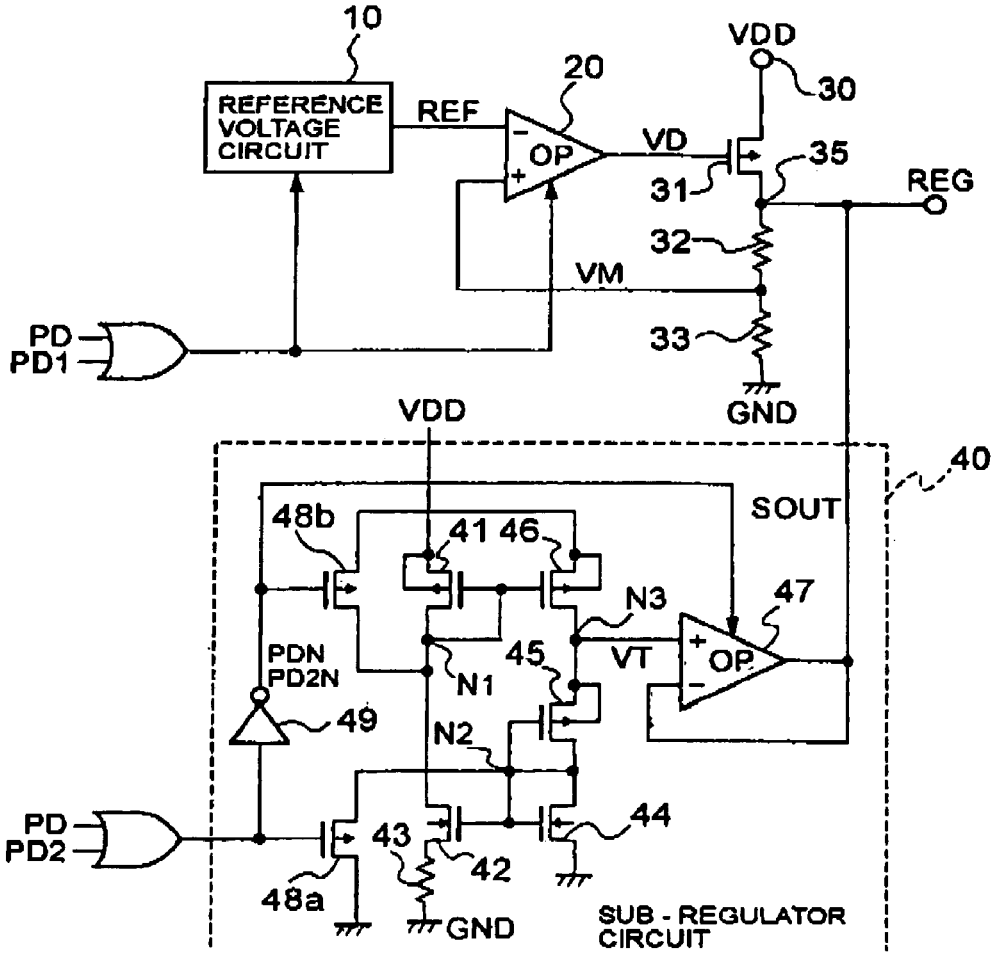
FIG. 2 is a configuration diagram of a voltage regulator showing a first embodiment of the present invention.

FIG. 2 is a configuration diagram of a voltage regulator showing a first embodiment of the present invention.

The voltage regulator is for regulating an externally supplied power-source voltage VDD and outputting a constant internal power voltage REG, which includes a reference voltage circuit 10 having a power-down function and an operational amplifier 20. The reference voltage circuit 10 generates a reference voltage REF based on a band gap or the like. For example, a switch element such as an N-channel MOS transistor (hereinafter referred to as "NMOS") is inserted intermediately to the ground voltage GND and placed under control according to power-down signals PD, PD1, the reference voltage circuit 10 can be cut off from the ground voltage GND and ceased from operating during sleep mode. Likewise, the operational amplifier 20 are also cut off from the ground voltage GND according to the power-down signals PD, PD1, and ceased from operating in sleep mode. Here, the power-down signal PD is to cause a power-down in the entire of the voltage regulator whereas the signal PD1 is to cause a power-down in the reference voltage circuit 10 and operational amplifier 20.

The reference voltage circuit 10 has an output connected to a "−" input terminal of the operational amplifier 20. The operational amplifier 20 has an output connected to a gate of a PMOS 31. The PMOS 31 has a source connected to a power terminal 30 through which a power voltage VDD is externally supplied. The drain of the PMOS 31 is connected to an output terminal 35 where a constant, internal power voltage REG is to be outputted. The output terminal 35 is connected with a load circuit, not shown. The output terminal 35 is connected to the ground voltage GND through resistances 32, 33 that constitute a voltage-divider circuit. The resistances 32, 33 has a connection whose voltage is supplied as a monitor voltage VM to a "+" input terminal of the operational amplifier 20.

Furthermore, the voltage regulator has a sub-regulator circuit 40 to generate a power voltage SOUT to be supplied to the load circuit in sleep mode. The sub-regulator 40 has an output connected to the output terminal 35.

The sub-regulator circuit 40 is configured with a reference-current circuit having a PMOS 41, an NMOS 42 and a resistance 43, a threshold-voltage output circuit having an NMOS 44 and a PMOS 45, a current source based on a PMOS 46, a voltage-follower circuit based on an operational amplifier 47, and a power-down control circuit having an NMOS 48*a*, a PMOS 48*b* and an inverter 49.

The reference-current circuit supplies a reference current in a magnitude depending upon a power voltage VDD and a value of the resistance 43. The source of the PMOS 41 is connected to the power voltage VDD while the gate and drain thereof is connected to a node N1. To the node N1 is connected the drain of the NMOS 42. The gate of the NMOS 42 is connected to a node N2 while the source thereof is to the ground voltage GND through the resistance 43.

The threshold-voltage output circuit generates a low power voltage SOUT as a backup voltage in sleep mode, based on a transistor threshold voltage VT. This is configured with the NMOS 44 and PMOS 45 in a forward diode connection, thus normally assuming on. The NMOS 44 has a source connected to the ground voltage GND, and a gate and drain connected to the node N2. The PMOS 45 has a gate and drain connected to the node N2, and a source connected to a node N3.

The current source supplies to the threshold-voltage output circuit a current in the same magnitude as the current flowing through the reference-current circuit, which is configured by a PMOS 46 assuming a current mirror to the PMOS 41. The PMOS 46 has a source connected to the power voltage VDD, a gate to the node N1 and a drain to the node N3, respectively. To the node N3 is connected the "+" input terminal of the operational amplifier 47 in a voltage-follower connection. The operational amplifier 47, at its output, is to output a threshold voltage VT, as a power voltage SOUT, to the node N3.

Meanwhile, the NMOS 48*a* of the power-down control circuit, connected between the node N2 and the ground voltage GND, is controlled on-off according to power-down signals PD, PD2. The PMOS 48*b*, connected between the power voltage VDD and the node N1, is controlled on-off according to power-down signals PDN, PDN2 generated by inverting the power-down signal PD, PD2 at an inverter 49. The power-down signal PD, PD2 is also used in controlling for power-down of the operational amplifier 47.

The operation is now described in the following.

In normal operation mode, power-down signals are provided as PD="L", PD1="L" and PD2="H", to normally operate the reference voltage circuit 10 and power amplifier 20. Namely, the reference voltage REF outputted from the reference voltage circuit 10 is provided to the "−" input terminal of the operational amplifier 20. To the "+" input terminal of the operational amplifier 20 is applied a monitor voltage VM that an internal power voltage REG at the output terminal 35 is voltage-divided by the resistances 32, 33. Incidentally, in the sub-regulator circuit 40, the NMOS 48*a* is turned on by a power-down signal PD2 in "H" to thereby bring the node N2 to the ground voltage GND while the PMOS 48*b* is turned on by a power-down signal PD2N in "L" to thereby bring the node N1 to the power voltage VDD. Consequently, the PMOSs 41, 46 turns off to cut off the current from the power voltage VDD. The operational amplifier 47 is applied by the power-down signal PD2 in "H" and ceased from operating.

When the monitor voltage VM becomes higher than the reference voltage REF, there is an increase of a detection voltage VD outputted from the operational amplifier 20, thus increasing the on-resistance of the PMOS 31 and lowering the internal power voltage REG at the output terminal 35. Conversely, when the monitor voltage VM becomes lower than the reference voltage REF, there is a decrease of a detection voltage VD outputted from the operational amplifier 20, thus decreasing the on-resistance of the PMOS 31 and raising the internal power voltage REG at the output terminal 35. By such a feedback operation, the monitor voltage VM is controlled equal to the reference voltage REF. Thus, the internal power voltage REG on the output terminal 35 is maintained constant in voltage regardless of the variations in the power voltage VDD or the load current flowing through the output terminal 35.

Meanwhile, in sleep mode, the power-down signal PD1 is "H" and the reference voltage circuit 10 and operational amplifier 20 is cut off from the ground voltage GND and hence ceased from operating. Thus, no current flows to the reference voltage circuit 10 and operational amplifier 20. Meanwhile, the operational amplifier 20 has a detection voltage VD in "H", to turn off the PMOS 31 and hence cut off the output terminal 35 from the power voltage VDD.

At this time, in the sub-regulator circuit 40, because the power-down signal PD2 assumes "L" to turn the NMOS 48*a* and PMOS 48*b* off, the PMOS 41 of the reference-current circuit has a reference current to flow in a magnitude depending upon the power voltage VDD and the value of the resistance 43. Thus, the corresponding current to the reference current is caused to flow through the PMOS 46 of the current source constituting a current mirror relative to the PMOS 41. The current through the PMOS 46 flows to the ground GND through the PMOS 45 and NMOS 44 of the threshold-voltage output circuit, thus outputting to the node N3 a voltage in a magnitude corresponding to the threshold voltage VT of the PMOS 45 and NMOS 44. The voltage at the node N3 is outputted as a power voltage SOUT to the output terminal 35 through the operational amplifier 47.

As described above, the voltage regulator in the first embodiment has the following advantages.

(1) The reference voltage circuit 10 and operational amplifier 20 has a power-down function. By ceasing those from operating according to a power-down signal PD1 in sleep mode, power consumption can be reduced.

(2) The sub-regulator circuit 40 is provided to output, in sleep mode, a power voltage SOUT in a magnitude different from and basically lower than the internal power voltage REG in the normal operation. A lower, backup power voltage can be supplied to the internal logic circuit, etc. operating in sleep mode, thus further reducing the power consumption in sleep mode.

(3) The sub-regulator circuit 40 is to generate a voltage in accordance with the transistor threshold voltage VT by means of the threshold-voltage output circuit, to output a power voltage SOUT in sleep mode. Accordingly, by forming the NMOSs 42, 44 and PMOS 45 configuring the threshold-voltage output circuit, etc. in a manner providing the same characteristic as the transistor of the internal logic circuit, etc. operating on the power voltage SOUT (e.g. in the same transistor structure), the optimal power voltage SOUT can be outputted.

(4) The sub-regulator circuit 40 has the reference-current circuit to supply a reference current in accordance with the value of the resistance 43. By adjusting the value of the resistance, useless power consumption can be suppressed down to the minimal degree. For example, provided that the current is minimally 0.5 μA to flow to the PMOS 45, etc. in order to cause a stable threshold voltage VT, the current consumption on the sub-regulator circuit 40 can be suppressed down to 1 μA.

In the first embodiment, the threshold-voltage output circuit of the sub-regulator circuit 40 is configured by a series connection of two transistors, i.e. the NMOS 44 and PMOS 45. Alternatively, three or more transistors can be employed in accordance with a threshold voltage required.

Meanwhile, the PMOSs 41, 46 constituting the current mirror may be each configured by a series connection of a plurality of PMOSs.

Figure 1:
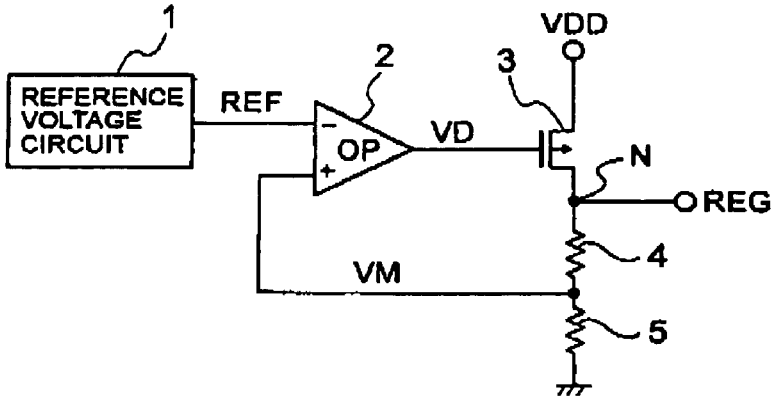
FIG. 1 PRIOR ART
FIG. 1 is a configuration diagram of a voltage regulator in a prior art.
Figure 3:
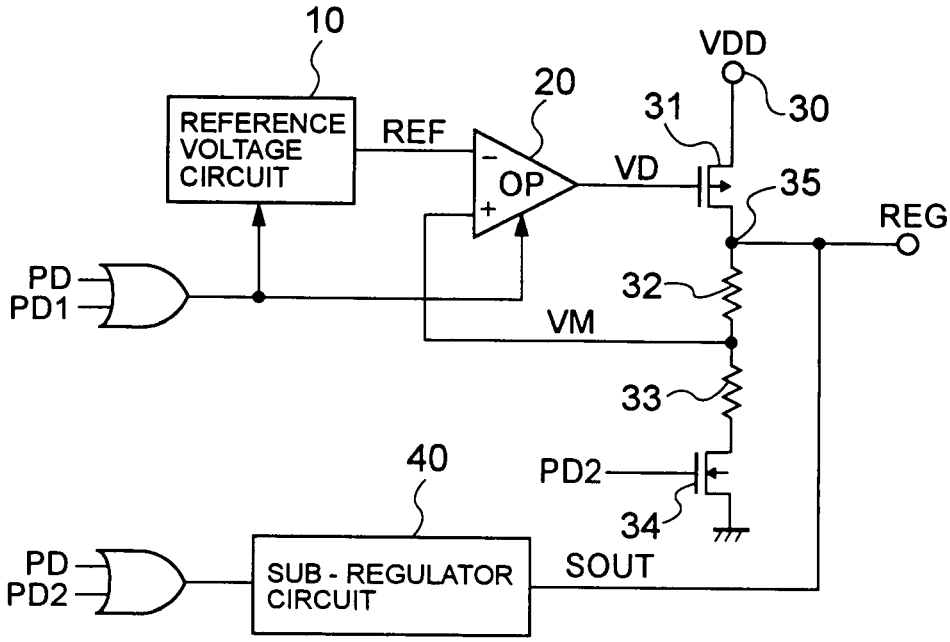
FIG. 3 is a configuration diagram of a voltage regulator showing a second embodiment of the invention.

FIG. 3 is a configuration diagram of a voltage regulator showing a second embodiment in the invention, wherein the common element to that of FIG. 1 is attached with the common reference.

The voltage regulator is configured with a switch NMOS 34 inserted, in the FIG. 2 voltage regulator, in series between the voltage-dividing circuit based on the resistances 32, 33 and the ground voltage GND so that the NMOS 34 can be controlled on-off according to a power-down signal PD1 common to the reference voltage circuit 10 and operational amplifier 20. The others are similar in structure to those of FIG. 2.

The voltage regulator, in normal operation mode, operates similarly to that of FIG. 2 because the NMOS 34 is turned on according to the power-down signal PD2 in "H". Although the monitor voltage VM is somewhat changed by the addition of an NMOS 34 on-resistance to the resistance 33, the change is extremely small as compared to the value of the resistance 32, 33 and hence slight in degree.

In sleep mode, because the power-down signal PD2 is "L", the NMOS 34 turns off. Due to this, the power voltage SOUT outputted from the sub-regulator circuit 40 is not allowed to flow to the ground voltage GND through the resistances 32, 33, further reducing the useless consumption of current.

Figure 6:
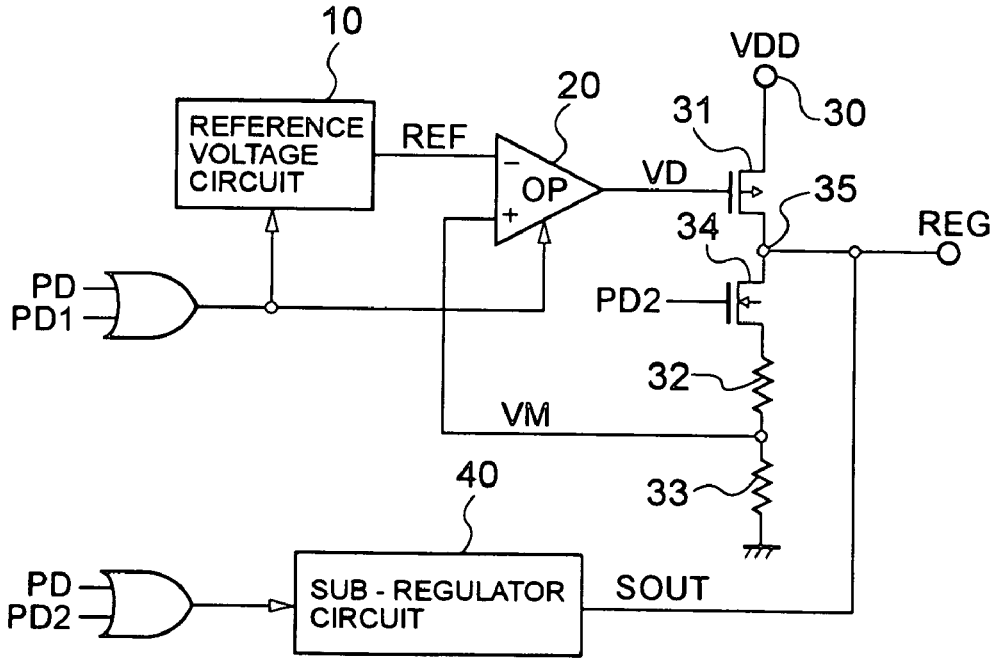
FIG. 6 is a configuration diagram of a modification of the voltage regulator of the second embodiment of the invention.

In this second embodiment, although the NMOS 34 is inserted between the resistance 33 and the ground voltage GND, the NMOS 34 may be inserted between the output terminal 35 and the resistance 32 as illustrated in FIG. 6.

Figure 4:
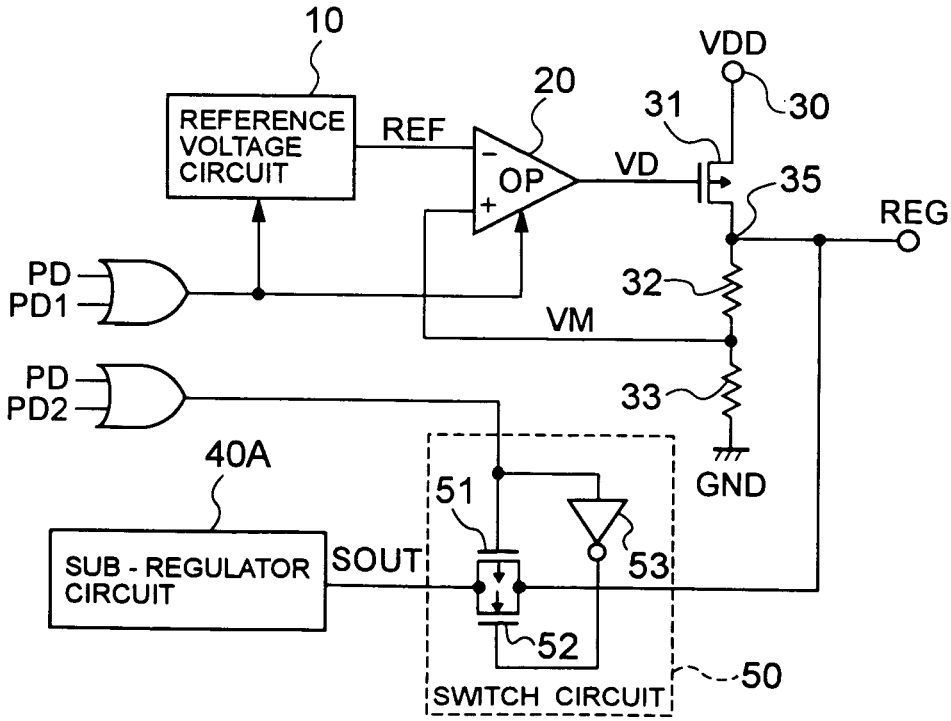
FIG. 4 is a configuration diagram of a voltage regulator showing a third embodiment of the invention.

FIG. 4 is a configuration diagram of a voltage regulator showing a third embodiment in the invention, wherein like reference numerals are used to denote the elements shown in FIG. 2.

In the voltage regulator, a sub-regulator circuit 40A somewhat simplified in configuration is provided in place of the sub-regulator circuit 40 of the FIG. 2 voltage regulator, wherein the output of the sub-regulator circuit 40A is connected to the output terminal 35 through a switch circuit 50.

The sub-regulator circuit 40A is a version of the FIG. 2 sub-regulator circuit 40 omitted of the power-down control circuit, i.e. NMOS 48*a*, PMOS 48*b* and inverter 49, and the operational amplifier 47 omitted of the power-down function. The switch circuit 50, so-called a transfer gate, is configured with a parallel connection of a PMOS 51 and an NMOS 52, in a manner to supply a logical sum of power-down signals PD, PD2 to a gate of the PMOS 51 and an inverted logical sum, by an inverter 53, of power-down signals PD, PD2 to a gate of the NMOS 52. The others are similar in structure to those of FIG. 2.

In the voltage regulator, power-down signals are provided as PD="L", PD1="L" and PD2="H", to perform a normal operation by the reference voltage circuit 10, the operational amplifier 20, the PMOS 31 and the resistances 32, 33. Meanwhile, the PMOS 51 and the NMOS 52 are both turned off in the switch circuit 50, to cut off the sub-regulator circuit 40 from the output terminal 35.

In sleep mode, power-down signals are provided as PD="L", PD1="H" and PD2="L", the reference voltage circuit 10 and the operational amplifier 20 are ceased from operating. Meanwhile, the PMOS 51 and the NMOS 52 are both turned on in the switch circuit 50, to output a power voltage SOUT of the sub-regulator circuit 40 through the output terminal 35.

As described above, in the voltage regulator of the third embodiment, the sub-regulator circuit 40A operates at all times. When switched into a sleep mode, a predetermined power voltage SOUT is immediately outputted, thus providing the advantage that the internal logic circuit, etc. can be prevented from malfunctioning due to voltage lowering during a switchover. Incidentally, although the sub-regulator circuit 40A operates in the normal operation, the current consumption thereof is approximately at 1 μA and hence can be ignored as compared to the LSI overall current consumption.

Figure 5:
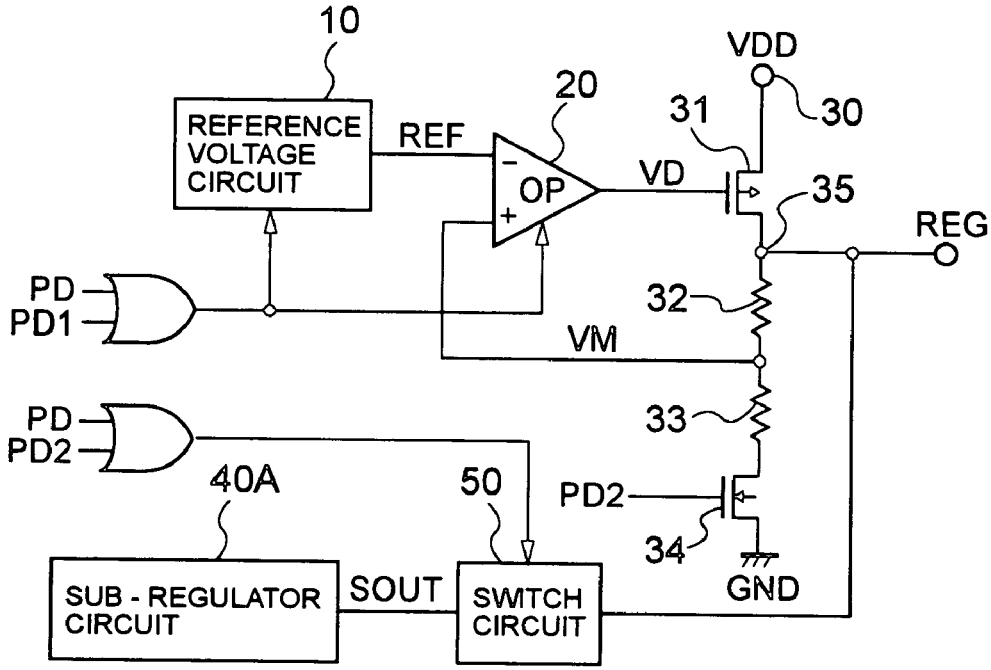
FIG. 5 is a configuration diagram of a voltage regulator showing a fourth embodiment of the invention.

FIG. 5 is a configuration diagram of a voltage regulator showing a fourth embodiment in the invention, wherein the common element to that of FIGS. 3 and 4 is attached with the common reference.

The voltage regulator is a combination of the FIGS. 3 and 4 voltage regulators, i.e. configured with a switch NMOS 34 inserted between the resistance 33 and the ground GND and a switch circuit 50 inserted between the output of the sub-regulator circuit 40A and the output terminal 35, to control the NMOS 34 according to a power-down signal PD2 and the switch circuit 50 according to power-down signals PD, PD2.

In the voltage regulator, power-down signals are provided as PD="L", PD1="L" and PD2="H" in normal operation mode, to turn on the NMOS 34. Thus, the normal operation based on the reference voltage circuit 10, operational amplifier 20, PMOS 31 and resistances 32, 33. Meanwhile, the switch circuit 50 becomes off and the sub-regulator circuit 40A is cut off from the output terminal 35.

In sleep mode, power-down signals are provided as PD="L", PD1="H" and PD2="L", to cease the reference voltage circuit 10 and operational amplifier 20 from operating and, furthermore, turn off the NMOS 34. This cuts off the output terminal from power voltage VDD and ground voltage GND. Meanwhile, the switch circuit 50 is turned on to output a power voltage SOUT of the sub-regulator circuit 40A though the output terminal 35.

As described above, the voltage regulator of the fourth embodiment has the NMOS 34 that is to be controlled on-off based on a power-down signal PD2 and the switch circuit 50 that is to be controlled on-off based on a power-down signals PD, PD2. Thus, there is an advantage that, when switched to a sleep mode, a predetermined power voltage SOUT can be outputted immediately and, furthermore, useless consumption of current can be diminished in the power voltage SOUT outputted from the sub-regulator circuit 40A in sleep mode.

Figure 7:
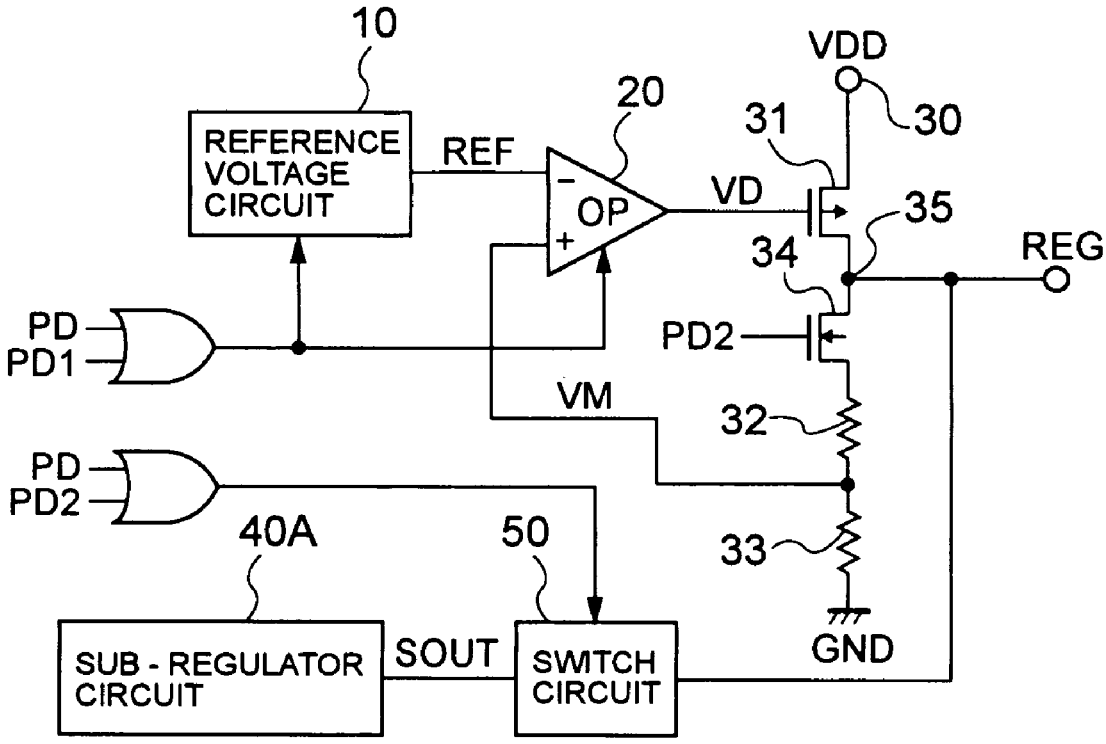
FIG. 7 is a configuration diagram of a modification of the voltage regulator of the fourth embodiment of the invention.

In the fourth embodiment, although the NMOS 34 is inserted between the resistance 33 and the ground voltage GND, the NMOS 34 may be inserted between the output terminal 35 and the resistance 32 as illustrated in FIG. 7.

This application is based on Japanese Patent Application No. 2005-210815 which is hereby incorporated by reference.

What is claimed is:

1. A voltage regulator comprising:

a reference voltage circuit that generates a reference voltage in a normal operation mode and ceases operation in a sleep mode;

an amplifier circuit that outputs in the normal operation mode a detection signal obtained by comparing a monitor voltage with the reference voltage and amplifying a difference therebetween and ceases operation in the sleep mode;

a P-channel MOS transistor that is connected between a power terminal a power voltage is to be supplied and an output terminal an internal power voltage is to be outputted, and to be controlled in conduction according to a detection voltage;

a resistance-based voltage-dividing circuit that is connected between a ground terminal a ground voltage is applied and the output terminal, and supplies to the amplifier circuit the monitor voltage obtained by dividing a voltage on the output terminal; and a sub-regulator circuit that generates a low power voltage different in magnitude from the internal power voltage and outputs same to the output terminal in the sleep mode, and ceases operation in the normal operation mode.

2. A voltage regulator comprising:

a reference voltage circuit that generates a reference voltage in the normal operation mode and ceases operation in a sleep mode;

an amplifier circuit that compares the reference voltage with a monitor voltage and outputs a detection voltage corresponding to a difference voltage thereof in a normal operation mode, and ceases operation in the sleep mode;

a P-channel MOS transistor that is connected between a power terminal a power voltage is to be supplied and an output terminal an internal power voltage is to be outputted, and to be controlled in conduction according to the detection voltage;

a resistance-based voltage-dividing circuit that is connected between a ground terminal a ground voltage is applied and the output terminal, and supplies to the amplifier circuit the monitor voltage obtained by dividing a voltage on the output terminal;

a sub-regulator circuit that generates a low power voltage than the internal power voltage; and a switch circuit that is connected between an output of the sub-regulator circuit and the output terminal, and turns on to output a lower power voltage generated in the sub-regulator circuit to the output terminal in the sleep mode and turns off in the normal operation mode.

3. A voltage regulator according to claim 1, wherein a switch transistor is provided by inserted to one of a first point of between the resistance-based voltage-dividing circuit and the ground terminal and a second point of between the resistance-based voltage-dividing circuit and the output terminal, to turn off in the sleep mode.

4. A voltage regulator according to claim 2, wherein a switch transistor is provided by inserted to one of a first point of between the resistance-based voltage-dividing circuit and the ground terminal and a second point of between the resistance-based voltage-dividing circuit and the output terminal, to turn off in the sleep mode.

5. A voltage regulator according to claim 1, wherein the sub-regulator circuit has a reference-current circuit that allows a reference current to flow via a first transistor and resistance connected between the power voltage and the ground voltage, a second transistor that allows a current according to the reference current to flow by constituting a current mirror circuit with respect to the first transistor, one or a plurality of third transistors normally on that output a threshold voltage based on a current supplied from the second transistor, and a voltage-follower circuit that outputs the threshold voltage as the low power voltage.

6. A voltage regulator according to claim 2, wherein the sub-regulator circuit has a reference-current circuit that allows a reference current to flow via a first transistor and resistance connected between the power voltage and the ground voltage, a second transistor that allows a current according to the reference current to flow by constituting a current mirror circuit with respect to the first transistor, one or a plurality of third transistors normally on that output a threshold voltage based on a current supplied from the second transistor, and a voltage-follower circuit that outputs the threshold voltage as the low power voltage.

7. A voltage regulator according to claim 3, wherein the sub-regulator circuit has a reference-current circuit that allows a reference current to flow via a first transistor and resistance connected between the power voltage and the ground voltage, a second transistor that allow a current according to the reference current to flow by constituting a current mirror circuit with respect to the first transistor, one or a plurality of third transistors normally on that output a threshold voltage based on a current supplied from the second transistor, and a voltage-follower circuit that outputs the threshold voltage as the low power voltage.

8. A voltage regulator according to claim 4, wherein the sub-regulator circuit has a reference-current circuit that allows a reference current to flow via a first transistor and resistance connected between the power voltage and the ground voltage, a second transistor that allows a current according to the reference current to flow by constituting a current mirror circuit with respect to the first transistor, one or a plurality of third transistors normally on that output a threshold voltage based on a current supplied from the second transistor, and a voltage-follower circuit that outputs the threshold voltage as the low power voltage.

9. A voltage regulator according to claim 5, wherein the third transistor is formed in a same transistor structure as a transistor constituting a load circuit operating on the lower power voltage in the sleep mode.

10. A voltage regulator according to claim 6, wherein the third transistor is formed in a same transistor structure as a transistor constituting a load circuit operating on the lower power voltage in the sleep mode.

11. A voltage regulator according to claim 7, wherein the third transistor is formed in a same transistor structure as a transistor constituting a load circuit operating on the lower power voltage in the sleep mode.

12. A voltage regulator according to claim 8, wherein the third transistor is formed in a same transistor structure as a transistor constituting a load circuit operating on the lower power voltage in the sleep mode.

13. A voltage regulator according to claim 1, wherein the reference voltage circuit and the amplifier circuit are configured to receive a power-down signal for stopping the operation in the sleep mode, and cut off from a ground potential in the sleep mode.

14. A voltage regulator according to claim 2, wherein the reference voltage circuit and the amplifier circuit are configured to receive a power-down signal for stopping the operation in the sleep mode, and cut off from a ground potential in the sleep mode.

15. A voltage regulator according to claim 3, wherein the reference voltage circuit and the amplifier circuit are configured to receive a power-down signal for stopping the operation in the sleep mode, and cut off from a ground potential in the sleep mode.

16. A voltage regulator according to claim 4, wherein the reference voltage circuit and the amplifier circuit are configured to receive a power-down signal for stopping the operation in the sleep mode, and cut off from a ground potential in the sleep mode.

17. A voltage regulator according to claim 5, wherein the sub-regulator circuit further has a power-down control circuit that, in the normal operation mode, stops the reference current circuit, the second transistor and the voltage-follower circuit from operating.

18. A voltage regulator according to claim 7, wherein the sub-regulator circuit further has a power-down control circuit that, in the normal operation mode, stops the reference current circuit, the second transistor and the voltage-follower circuit from operating.

19. A voltage regulator according to claim 8, wherein the sub-regulator circuit further has a power-down control circuit that, in the normal operation mode, stops the reference current circuit, the second transistor and the voltage-follower circuit from operating.

* * * * *